US008533929B2

(12) United States Patent
Kim et al.

(10) Patent No.: US 8,533,929 B2
(45) Date of Patent: Sep. 17, 2013

(54) COIN ASSEMBLY AND MEDAL ASSEMBLY, AND METHOD FOR FABRICATING THE SAME

(75) Inventors: Won Hone Kim, Ulsan (KR); Jong Soo Yuem, Gyeongsangnam-do (KR)

(73) Assignee: Poongsan Corporation, Gyeonggi-do (KR)

( * ) Notice: Subject to any disclaimer, the term of this patent is extended or adjusted under 35 U.S.C. 154(b) by 197 days.

(21) Appl. No.: 13/123,651

(22) PCT Filed: Sep. 27, 2010

(86) PCT No.: PCT/KR2010/006540

§ 371 (c)(1),
(2), (4) Date: Apr. 11, 2011

(87) PCT Pub. No.: WO2011/071234

PCT Pub. Date: Jun. 16, 2011

(65) Prior Publication Data

US 2011/0268908 A1 Nov. 3, 2011

(30) Foreign Application Priority Data

Dec. 7, 2009 (KR) ..... 10-2009-0120454

(51) Int. Cl.
*B21D 39/00* (2006.01)

(52) U.S. Cl.
USPC ..... 29/522.1

(58) Field of Classification Search
USPC ..... 29/522.1, 428, 469; 40/27.5, 661.05, 40/675; 428/60, 579, 609, 600; 72/39
See application file for complete search history.

(56) References Cited

U.S. PATENT DOCUMENTS 5,996,262 A * 12/1999 Kim ..... 40/27.5
6,189,197 B1 * 2/2001 Kim ..... 29/522.1

FOREIGN PATENT DOCUMENTS

| | | |
|---|---|---|
| EP | 0 080 437 A1 | 6/1983 |
| EP | 0 529 349 A1 | 3/1993 |
| KR | 10-0144703 | 4/1998 |
| KR | 10-0144704 | 4/1998 |

* cited by examiner

*Primary Examiner* — John C Hong
(74) *Attorney, Agent, or Firm* — Morgan, Lewis & Bockius LLP

(57) ABSTRACT

A coin assembly and a medal assembly which have triple-structures, respectively, and a method for fabricating the same are disclosed. The coin assembly includes an internal ring; an external ring coupled to an outside of the internal ring; an insert coupled to an inside the internal ring; a first recess formed in an outer surface of the internal ring, to have a predetermined portion of an outer surface of the external ring inserted therein, when the internal ring and the external ring are assembled with each other; and a second recess formed in an outer surface of the insert, to have a predetermined portion of an outer surface of the internal ring therein, when the insert and the internal ring are assembled with each other.

2 Claims, 7 Drawing Sheets

COIN ASSEMBLY AND MEDAL ASSEMBLY, AND METHOD FOR FABRICATING THE SAME

TECHNICAL FIELD

The present invention relates to a coin assembly and a medal assembly which have triple-structures, respectively, and a method for fabricating the same.

BACKGROUND ART

Generally, bimetal coins or medals are metal assemblies made of different metals which are used to prevent counterfeits and to upgrade a product high quality. Such a bimetal coin or medal is configured of an external coin for defining an external appearance and an internal coin coupled to the external coin.

Such the bimetal coin (coupling body of the external and internal coins) is configured of two kinds of metals coupled to each other. because of that, even if quite a shock is applied to the bimetal coin, the bimetal coin is required not to be separated into the external coin and the internal coin which are made of different metals.

According to a conventional bimetal coin, a recess is formed in an inner surface of an external coin and a predetermined projection is formed in an outer surface of an internal coin to be inserted in the recess of the external coin. When the internal coin is insertedly coupled to the external coin, the internal coin is stretched for the projection formed in the outer surface of the internal coin to be inserted inn the recess formed in the inner surface of the external coin. As a result, the internal coin and the external coin are coupled to each other.

In the meanwhile, according to another type of the conventional bimetal coin, a projection is formed in the inner surface of the external coin and the internal coin is formed in a simple circular shape. It is well-known that the internal coin is stretched enough to surround the projection of the external coin, as it is intertedly coupled to the external coin.

However, according to the above two types of conventional bimetal coins, it is required to form the recess or projection in the inner surface of the external coin.

Because of that, it is very difficult and it costs quite a lot to form the inner surface of the external coin. Without exclusive equipment for forming the inner surface, it is impossible to process the inner surface of the external coin.

Moreover, in case of a bimetal coin or medal having a small inner diameter of an external coin, it is commercially impossible to process a recess or projection in the small inner surface.

Alternatively, different from the above conventional ones, a recess portion is formed in a center of an outer surface of an inner coin along a circumference direction and an external coin is thicker than the inner coin, without any process of an inner surface of the external coin. When the inner coin is insertedly coupled to the external coin after that, an inner portion of the external coin is plastically inserted in the recess portion of the inner coin, to couple the external and inner coins to each other. This technology is included in the conventional art to which the present invention pertains.

However, that technology goes against natural metal flow generated in the pressingly inserted process.

In other words, the natural metal flow (the direction of the metal stretching generated in the plastic transformation) generated in the inserted coupling process will occur toward a direction of increased inner and outer diameters. In contrast, according to above technology, the recess portion is formed in the center of the outer surface of the inner coin. Because of that, during the insertedly coupling process, the size of the recess portion happens to be decreased by the metal flow.

As a result, when fabricating the bimetal coin or medal by using the above technology, the outer diameter of the external coin is molded during the insertedly coupling process. Because of that, extra metal which is the external coin (the metal amount transformed by the pressing of the insertedly coupling process) has to be forced to flow into the recess portion of the internal coin, with plastically transformed. Thus, there would be a problem of an external press requiring a large energy which has to be applied. The coupling between the external and internal coins cannot help deteriorating, because it goes against natural metal flow.

Furthermore, all of the above conventional inventions disclose only the structure configured of two elements including the inner coin (insert) and the external coin (external ring), failing to disclose a new type of coins or medal applicable to fabricate a more highly cost coin or commemoration medal.

DISCLOSURE OF INVENTION

Technical Problem

To solve the problems, an object of the present invention is to provide a coin assembly and a medal assembly which have triple-structures, respectively, and a method for fabricating the same.

Technical Solution

To achieve these objects and other advantages and in accordance with the purpose of the invention, as embodied and broadly described herein, a coin assembly includes an internal ring; an external ring coupled to an outside of the internal ring; an insert coupled to an inside the internal ring; a first recess formed in an outer surface of the internal ring, to have a predetermined portion of an outer surface of the external ring inserted therein, when the internal ring and the external ring are assembled with each other; and a second recess formed in an outer surface of the insert, to have a predetermined portion of an outer surface of the internal ring therein, when the insert and the internal ring are assembled with each other.

The first recess may be formed along the outer surface of the internal ring and the second recess may be formed along the outer surface of the insert.

The coin assembly may further include a first edge projected from a circumference of at least one of front and rear surfaces of the internal ring; and a second edge projected from a circumference of at least one of front and rear surfaces of the insert.

In another aspect of the present invention, a medal assembly includes an internal ring; an external ring coupled to an outside of the internal ring; an insert coupled to an inner portion of the internal ring; a first recess formed in an outer surface of the internal ring, to have an inner surface of the external ring inserted therein, when the internal ring and the external ring are assembled with each other; and a second recess formed in an outer surface of the insert, to have an inner surface of the internal ring inserted therein, when the insert and the internal ring are assembled with each other.

The first recess may be formed along the outer surface of the internal ring and the second recess may be formed along the outer surface of the insert.

The medal assembly may further include a first edge projected from a circumference of at least one of front and rear surfaces of the internal ring; and a second edge projected from a circumference of at least one of front and rear surfaces of the insert.

A further aspect of the present invention, a method for fabricating a coin assembly includes (a) step configured to punch inner and outer surfaces of an external ring and to anneal and acid-pickle the punched inner and outer surfaces; (b) step configured to punch inner and outer surfaces of an internal ring and to process a recess in the outer surface, and configured to process an edge in a circumference of at least one of front and rear surfaces of the insert and to anneal and to anneal and acid-pickle the edge; (c) step configured to punch and anneal an insert and to process a recess in an outer surface of the insert, and configured to process an edge in at least one circumference of front and rear surfaces of the insert and to acid-pickle the edge; and (d) step configured to couple the insert to the inner surface of the internal ring and to press-assemble the insert, the internal ring and the external ring with each other to allow the inner surface of the internal ring inserted in the recess of the insert and the inner surface of the external ring inserted in the recess of the internal ring.

The inner and outer surfaces of the external ring may be punched perpendicularly in the step (a), and the inner and outer surfaces of the internal ring may be punched perpendicularly in the step (b).

The step (d) may press-assemble the internal ring with the external ring, after pressing the internal ring and the insert to be assembled with each other.

The step (d) may press-assemble the insert with the internal ring after pressing the external ring and the internal ring to be assembled with each other.

The step (d) may press-assemble the internal ring, the external ring and the insert with each other simultaneously.

A still further aspect of the present invention, a method for fabricating a medal assembly includes (e) step configured to punch inner and outer surfaces of an external ring and to anneal and acid-pickle the inner and outer surfaces; (f) step configured to punch inner and outer surfaces of an internal ring and to process a recess in the outer surface, and configured to process an edge in at least one circumference of front and rear surfaces of the internal ring and to anneal and acid-pickle the edge; (g) step configured to punch and anneal an insert and to process a recess in an outer surface of the insert, and configured to process an edge in at least one circumference of front and rear surfaces of the insert and to acid-pickle the edge; and (h) step configured to couple the insert to the inner surface of the internal ring and the external ring to the outer surface of the internal ring, and configured to press-assemble the insert and the external ring with each other to allow the inner surface of the internal ring inserted in the recess of the insert and the inner surface of the external ring inserted in the recess of the internal ring.

The inner and outer surfaces of the external ring may be punched perpendicularly in the step (e), and the inner and outer surfaces of the internal ring may be punched perpendicularly in the step (g).

The step (h) may press-assemble the internal ring with the external ring, after pressing the internal ring and the insert to be assembled with each other.

The step (h) may press-assemble the insert with the internal ring, after pressing the external ring and the internal ring to be assembled with each other.

The step (h) may press-assemble the internal ring, the external ring and the insert with each other simultaneously.

The present invention is described in an order of the processes for convenience sake. However, the order of the punching and processing the internal ring, the insert and the external ring may be changeable. Also, after the internal ring and the insert are insertedly pressed, the external ring may be press-assembled with the assembly of the two. Alternatively, after the internal ring and the external ring are pressed, the insert is press-assembled with the assembly of the two. Also, the internal ring, the insert and the external ring may be pressed simultaneously. As a result, the present invention may not be applicable only to the one of the process order.

Advantageous Effects

The present invention has following advantageous effects.

According to the present invention, the assembly coherence between the external ring and the bimetal configured of the internal ring and the insert and the assembly coherence between the internal ring and the insert may be improved advantageously.

Furthermore, the assembled portion between the external ring and the internal ring and the assembled portion between the insert and the internal ring may be structurally excellent. As a result, the triple metal coin and medal having excellent exterior surface appearances may be achieved.

BRIEF DESCRIPTION OF THE DRAWINGS

The accompanying drawings, which are included to provide further understanding of the disclosure and are incorporated in and constitute a part of this application, illustrate embodiments of the disclosure and together with the description serve to explain the principle of the disclosure.

In the drawings.

BEST MODE

Reference will now be made in detail to the specific embodiments of the present invention, examples of which are illustrated in the accompanying drawings. Wherever possible, the same reference numbers will be used throughout the drawings to refer to the same or like parts.

Figure 1:
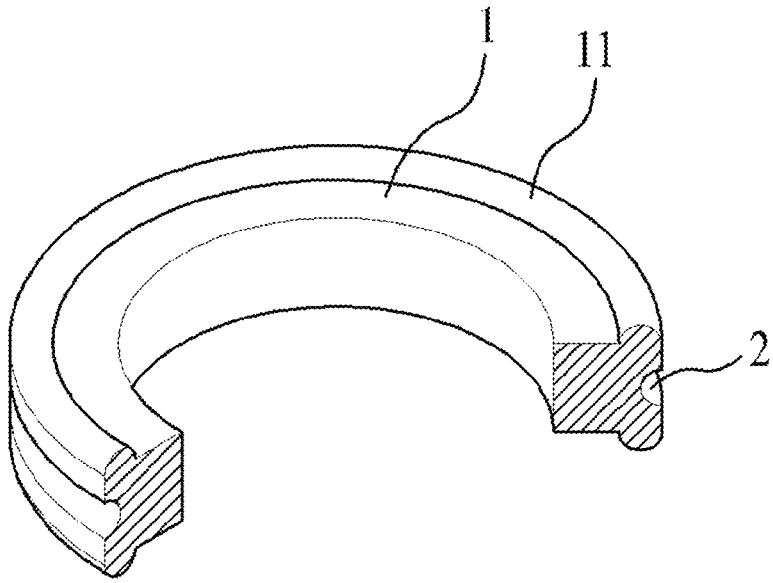
FIG. 1 is a perspective view of an internal ring according to the present invention.

FIG. 1 illustrates an internal ring 1 composing a triple metal coin assembly or medal assembly according to the present invention and a first recess 2 is provided along a circumference of an outer surface of the internal ring 1.

Here, inner and outer surfaces of the internal ring 1 are punched perpendicularly and the first recess 2 is arranged along the circumference of the outer surface. After that, the internal ring 1 having the punched inner and outer surfaces, with the first recess 2 formed along the circumference, is annealed and acid-pickled.

The first recess 2 is engraving-band-shaped, formed in the circumferential surface of the internal ring 1.

Also, a projected ring-shaped first edge 11 is formed in both of front and rear surfaces or at least one circumference of the internal ring 1.

Figure 2:
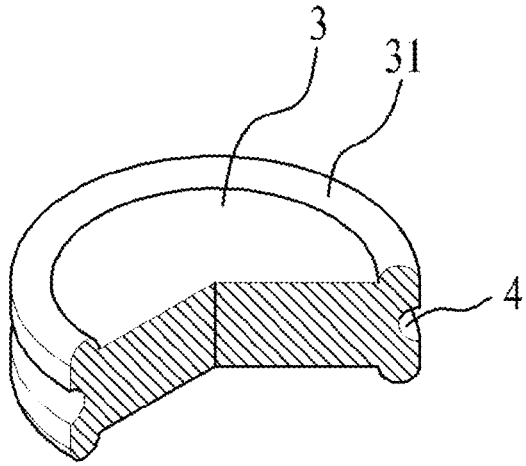
FIG. 2 is a perspective view of an insert according to the present invention.

FIG. 2 illustrates an insert 3 insertedly coupled to the inside of the internal ring 1. The insert 3 is disc-shaped, with a predetermined thickness.

Here, to fabricate the insert 3, a predetermined disc-shaped metal material is punched and annealed and after that, a second recess 4 is processed in an outer circumferential surface of the insert 3. After a projected ring-shaped second edge 31 is formed in both of front and rear surfaces or at least one circumference of the front and rear surfaces, the insert 3 having the second edge 31 is acid-pickled.

The second recess 4 is also engraving band-shaped, with formed in the circumference of the insert 3.

Figure 3:
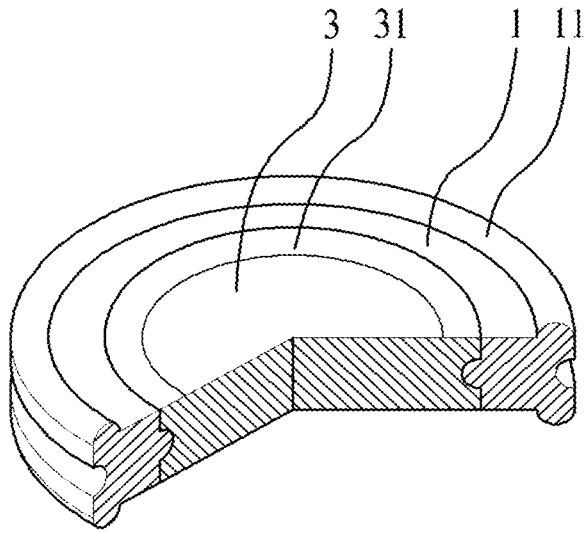
FIG. 3 is a perspective view illustrating an assembly configured of the internal ring and the insert according to the present invention.

FIG. 3 illustrates an assembly of the inserting ring and the insert 3. The internal ring 1 and the insert 3 are overlapped and a press presses the overlapped ones to fabricate the assembly.

The press process is performed to couple the internal ring 1, the insert 3 and the external ring 5 gained through the above process to each other. In the press process, the internal ring 1, the insert 3 and the external ring 5 are compressed in an upward and downward direction. Such the press process enables the first edge 11 formed in the internal ring 1 and the edge 11 formed in the insert 3 to be compressed to fill an aperture between the internal ring 1 and the insert and another aperture between the external ring 5 and the internal ring 1.

The front and rear surfaces of each of the internal ring and the insert 3 are transformed in parallel to the front and rear surfaces of the external ring 5, only to maintain a smooth surface state.

When the internal ring 1 and the insert 3 are press-assembled with each other, a predetermined portion of the outer surface of the internal ring 1 is plastically transformed to be inserted in the second recess 4 of the insert 3. The assembling performed between such the plastically transformed portion and the second recess 4 allows the assembling between the internal ring 1 and the insert 3 to be maintained.

Figure 4:
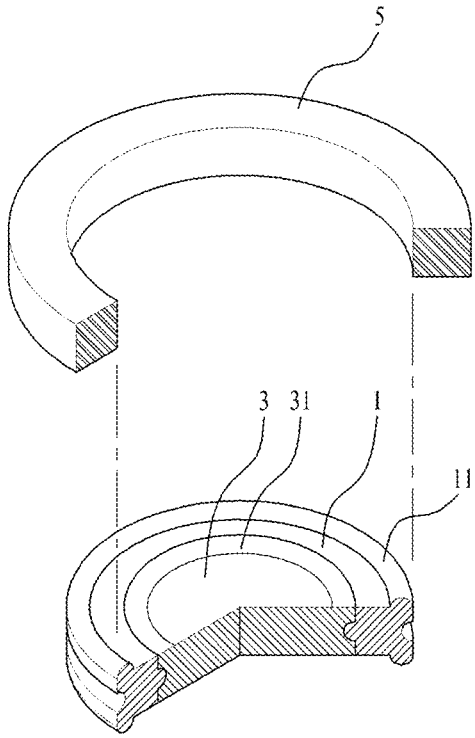
FIG. 4 is a perspective view illustrating the assembly of the internal ring and the insert and an external ring.

FIG. 4 illustrates an assembling process between an external ring 5 composing an outermost part of the triple metal coin assembly or medal assembly according to the present invention and the assembly of the insert 3 and the internal ring 5 which will be assembled with the external ring 5.

Inner and outer surfaces of a circular ring shaped metal material may be punched perpendicularly and the metal material having the punched inner and outer surfaces is annealed and acid-pickled, to fabricate the external ring 5.

The assembly of the insert 3 and internal ring 1 is overlapped with the external ring 5. after that, the press presses them and the inner surface of the external ring 5 is plastically transformed to be inserted in the first recess 2 formed in the outer surface of the internal ring 1.

Figure 5:
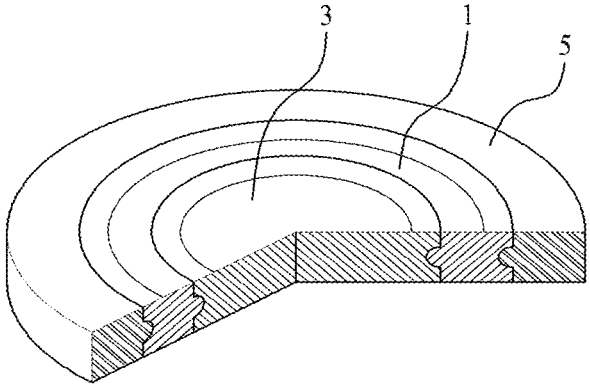
FIG. 5 is a perspective view illustrating a coupling process between the internal ring and the insert and the external ring.

As a result, the triple metal coin assembly or medal assembly configured of the insert 3, the internal ring 1 and the external ring 5 may be fabricated as shown in FIG. 5.

Here, the second recess 4 formed in the insert 3 has a recess depth of 0.05~0.25 mm from the outer surface of the insert 3 and a width of 20~50% with respect to the initial thickness of the insert 3.

If the depth and width of the second recess 4 is too small, the assembly coherence between the insert and the internal ring is weakened and if they are too large, the working process of the second projection 4 is getting difficult and the external appearance is deteriorated.

The thickness of the insert 3 is larger than the thickness of the internal ring 1 by 1~3%. If the thickness difference is less than 1%, extra metal is reduced to fail to fill the aperture between the insert and the internal ring beautifully. If the difference is more than 3%, the extra metal is too much to fill the aperture.

Also, the first recess 2 formed in the internal ring 1 has a recess depth of 0.05~0.25 mm from the outer surface of the internal ring 1 and a width of 20~50% with respect to the initial thickness of the internal ring 1.

If the depth and width of the first recess 2 is too small, the assembly coherence between the internal ring 1 and the external ring 5 is weakened and if they are too large, the working process of the second projection 4 is getting difficult and the external appearance is deteriorated.

FIGS. 1 to 5 shows that the external ring 5 is assembled after the insert 3 and the internal ring 1 are coupled to each other.

Figure 6:
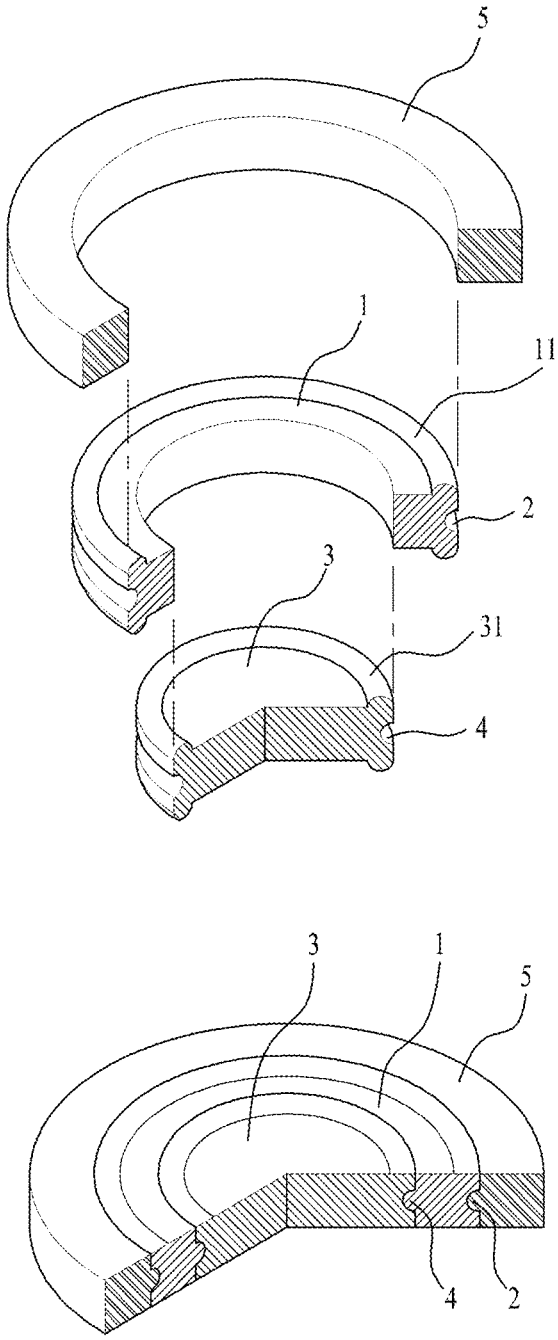
FIG. 6 is a perspective view illustrating an assembly of the insert, the internal ring and the external ring which are coupled to each other simultaneously.

Different from that, as shown in FIG. 6, the insert 3, the internal ring 1 and the external ring 5 are placed together to be pressured at one time.

In this case, the inner surface of the external ring 5 is inserted in the first recess 2 and the inner surface of the internal ring 1 is inserted in the second recess 4 simultaneously. After that, a triple metal coin or medal assembly may be fabricated at one time.

Figure 7:
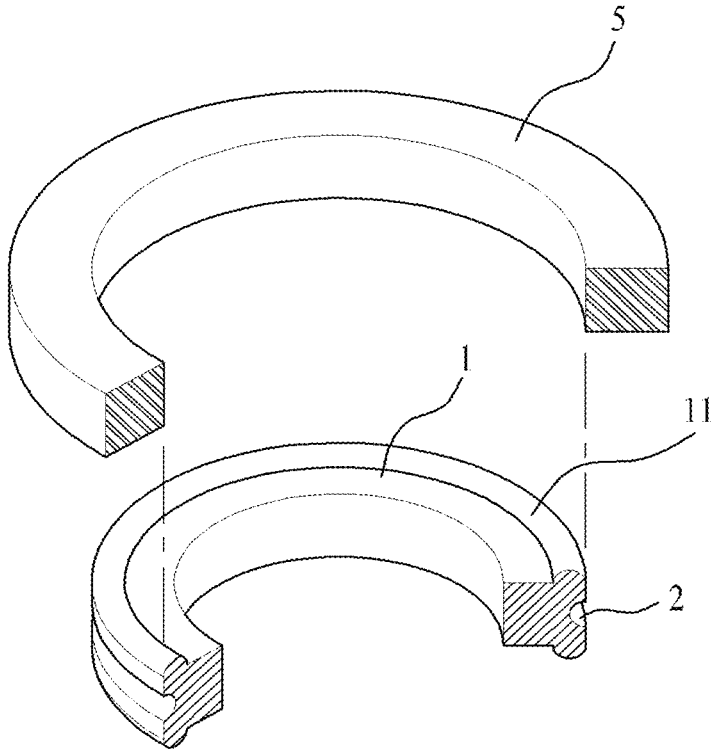
FIG. 7 is a perspective illustrating the insert and the internal ring according to the present invention.
Figure 8:
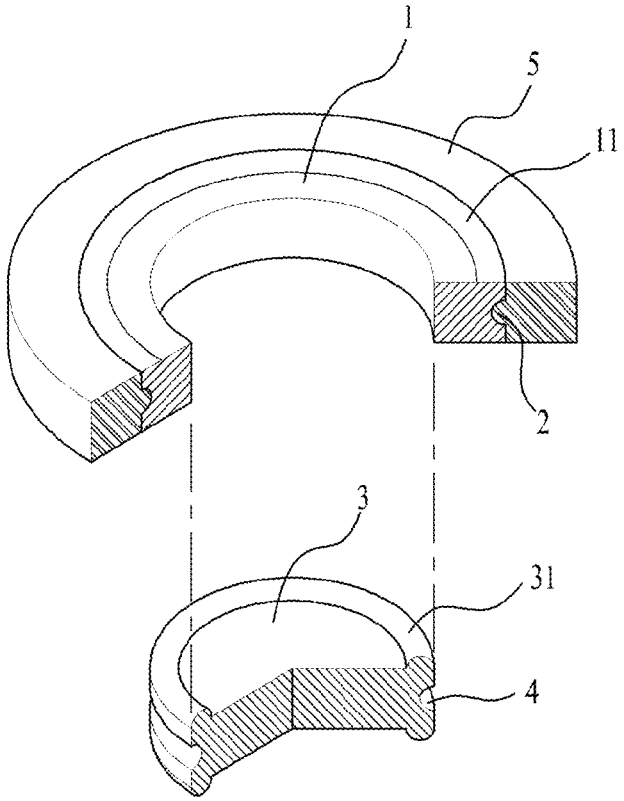
FIG. 8 is perspective view illustrating the assembly of the insert and the internal ring and the external ring.
Figure 9:
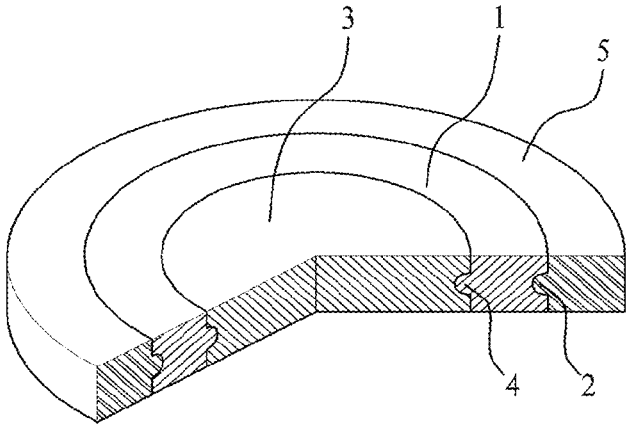
FIG. 9 is a perspective view illustrating a coupling process of the internal ring and the insert to the external ring.

FIGS. 7 to 9 show that the assembly of the external ring 5 and the internal ring 1 which are press-assembled with each other is press-assembled with the insert 3.

According to FIG. 7, the external ring 5 and the internal ring 1 are overlapped to be pressed by the press. After that, the inner surface of the external ring 5 is inserted in the first recess 2 of the internal ring 1 thoroughly.

At this time, the inner surface of the external ring 5 is plastically transformed to be inserted in the first recess 2 and the plastically transformed portion is coupled to the first recess 2, such that the external ring 5 may be assembled with the internal ring 1.

As shown in FIG. 8, the assembly of the internal and external rings 1 and 5 is overlapped with the insert 3 to be pressed by the press again. After that, the inner surface of the internal ring 1 is plastically transformed to be inserted in the second recess 4 of the insert 3 thoroughly.

At this time, the inner surface of the internal ring 1 is plastically transformed to be insertedly coupled to the second recess 4 and the plastically transformed portion is coupled to the second recess 4, such that the internal ring 1 may be assembled with the insert 3.

As a result, the triple metal coin assembly or medal assembly according to the present invention may be completed.

As follows, specific embodiments of the present invention will be described.

First Embodiment

First of all, the external ring 5 (Cu:75%, Ni:25%) is punched to have a thickness of 1.80 mm, with the outer surface having a thickness of 27.90 mm and the inner surface having a thickness of 22.0 mm, and the punched external ring 5 is annealed and acid-pickled. The internal ring (a middle ring) 1 (Cu: 92%, Ni: 2%, AL: 6%) is punched to have a thickness of 1.81 mm, with the outer surface having a thickness of 21.85 mm and the inner surface having a thickness of 16.90 mm. after that, the recess is processed in the punched internal ring and the external ring 5 is annealed and acid-pickled. The insert (Cu:75%, Ni:25%) is punched to have a thickness of 1.82 mm, with a diameter of 17.10 mm, and the punched insert 3 is annealed. After that, the recess is processed in the insert 3 and the insert is annealed and acid-pickled. Then, both of the internal ring 1 and the insert 3 are coupled firstly to be imprinted, such that the bimetal assembly (the assembly of the internal ring and the insert) is formed and that the bimetal assembly may be re-assembled with the external ring to be imprinted.

Here, each depth of the first and second recesses 2 and 4 may be approximately 0.05~0.25 mm.

Figure 10:
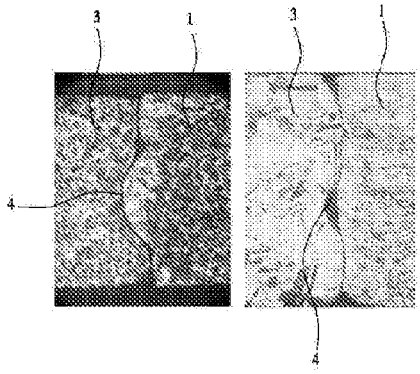
FIG. 10 is a microphotograph taken in the coupling process between the internal ring and the insert.

FIG. 10 is a microphotograph taken to describe the assembling state between the internal ring 1 and the insert 3.

As shown in the microphotograph, when the internal ring 1 and the insert 3 are press-assembled with each other by the press, the press allows the predetermined portion of the inner surface of the internal ring 1 to be plastically transformed, to be inserted in the second recess 4 provided in the insert 3.

As a result, the internal ring 1 and the insert 3 are assembled with each other. Such the assembling structure may be applicable to the assembling process between the internal ring 1 and the external ring 5.

Figure 11:
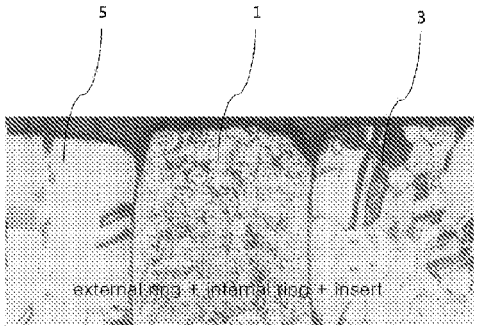
FIG. 11 is a photograph of a coupling part provided in a coin assembly or metal assembly according to an embodiment of the present invention.

FIG. 11 is a microphotographs of the assembly state of the triple metal coin according to the embodiment of the present invention to show a cut-away sectional view partially illustrating the triple metal coin assembly or medal assembly configured of the external ring 5, the internal ring 1 and the insert 3 assembled with each other.

The result of the embodiment is shown in Table 1.

Here, the thickness of the edge refers to the overall thickness of the portion the internal ring or insert in which the edge is formed.

TABLE 1

| Category | | Result (mm) - Average |
|---|---|---|
| Outer Diameter (mm) | Triple Metal (Internal Ring + Insert + External Ring) | 27.97 |
| | Bimetal (Internal Ring + Insert) | 21.94 |
| Thickness (mm) | Triple Metal (Internal Ring + Insert + External Ring) | 1.80 |
| | Bimetal (Internal Ring + Insert) | 1.81 |
| Edge Thickness (mm) | First Edge Of Internal Ring | 2.00 |
| | Second Edge Of Insert | 2.13 |
| Assembly Coherence (hg/mm$^2$) | Internal Ring + Bimetal (Internal Ring + Insert) | 151.24 |
| | Ring (External Ring + Internal Ring Assembly) + Insert | 104.73 |
| | Conventional Bimetal (Internal Ring + Insert) | 60 |

According to the present invention mentioned above, the assembly coherence between the external ring 5 and the bimetal assembly (assembly of the internal ring 1 and the insert 3) and the assembly coherence between the internal ring and the insert are noticeably improved and this technical advantage is enjoyable, compared with the conventional bimetal.

The reason why the assembly coherence is improved is that the external ring 5 forcedly inserted in the internal ring 1 is employed as external mold with respect to the internal ring 1 and that the force is transmitted to the internal ring 1 from the external ring 5 accordingly.

This force is transmitted to the assembled portion between the insert 3 and the internal ring 1, that is, the assembled portion between the recess of the insert 3 and the inner surface of the internal ring 1 via the internal ring 1. Because of that, the assembly coherence may be improved more than the simple assembly of the insert 3 and the internal ring 1.

In the meanwhile, the insert 3 is forcedly inserted in the internal ring 1, in the state of the external ring 5 being assembled with the internal ring 1, that is, in the state of the inner surface of the external ring 5 being inserted in or insertedly assembled with the first recess 2 formed in the outer surface of the internal ring 1. Because of that, a predetermined pushing force toward the internal ring 1 from the insert 3 is applied and this force is transmitted to the assembled portion between the external ring 5 and the internal ring 1 via the internal ring 1.

As a result, the assembly coherence in the state of the insert being inserted in the internal ring 1 may be noticeably improved, compared with the simple assembly of the external ring 5 and the internal ring 1.

Such the improvement of the assembly coherence may allow the cohering state of the triple metal coin assembly or medal assembly performed more stably and advantageously.

The inner surface of the internal ring 1 is inserted in or insertedly coupled to the second recess 4 of the insert 3 and the inner surface of the external ring 5 is also insertedly coupled to the first recess 2 of the internal ring 1. However, little exterior transformation may occur in the outer surface and there may be little difference between the thickness of the internal ring 1 and the insert 3 and the thickness of the external ring 5. Because of that, the exterior surface appearance of the triple metal coin assembly or medal assembly may be kept excellent.

Second Embodiment

The external ring 5 (Cu:92%, Ni:2%, Al:6%) is punched, annealed and acid-pickled to have a thickness of 1.80 mm, an outer diameter of 27.90 mm and an inner diameter of 22.0 mm and the punched external ring 5 is annealed and acid-pickled. The internal ring (middle ring) 1 is punched to have a thickness of 1.81 mm, an outer diameter of 21.85 and an inner diameter of 16.90 mm and after that, the first recess 2 is processed and the annealing and pickling processes are performed. The insert 3 (Cu: 92%, Ni: 2%, Al: 6%) is punched to have a thickness of 1.82 mm, a diameter of 17.10 mm and it is annealed. After that, the second projection 4 is processed and acid-pickled. Then, the internal ring 1 and the insert 3 are coupled and imprinted to fabricate the bimetal assembly and this bimetal assembly is coupled and imprinted with the external ring 5.

The recess depth and width of the first recess 2 formed in the internal ring 1 is 0.15 mm and 0.50 mm. The thickness of the first edge 11 is 2.25 mm. The recess depth and width of the second recess 4 formed in the insert 3 is 0.15 mm and 0.50 mm, respectively, and the thickness of the second edge 31 is 2.35 mm.

Figure 12:
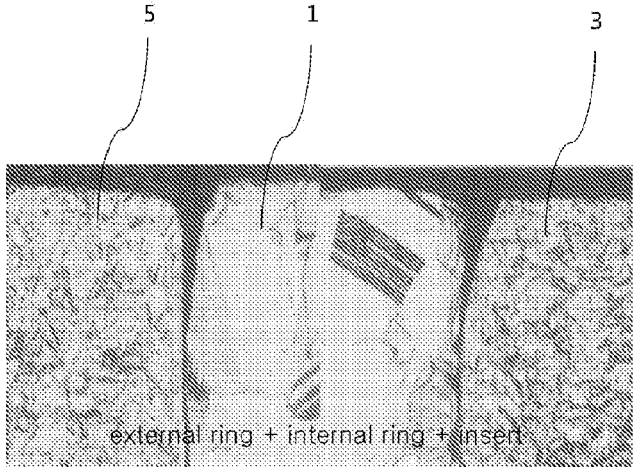
FIG. 12 is a photograph of a coupling part provided in a coin assembly or metal assembly according to another embodiment of the present invention.

FIG. 12 is a microphotograph of the assembly state of the triple metal coin assembly or medal assembly according to a second embodiment of the present invention to show a partially cur-away sectional view of the triple metal coin configured of the external ring 5, the internal ring 1 and the insert 3.

The result according to the embodiment of the present invention is shown in Table 2.

Here, the edge thickness refers to the overall thickness of the portion of the internal ring or insert in which the edge is formed.

TABLE 2

| Category | | Result (mm) - Average |
|---|---|---|
| Outer Diameter (mm) | Triple Metal (Internal Ring + Insert + External Ring) | 27.99 |
| | Bimetal (Internal Ring + Insert) | 21.94 |
| Thickness (mm) | Triple Metal (Internal Ring + Insert + External Ring) | 1.80 |
| | Bimetal (Internal Ring + Insert) | 1.81 |
| Edge Thickness (mm) | First Edge Of Internal Ring | 2.25 |
| | Second Edge Of Insert | 2.35 |
| Assembly Coherence ($hg/mm^2$) | Internal Ring + Bimetal (Internal Ring + Insert) | 112.07 |
| | Ring (External Ring + Internal Ring Assembly) + Insert | 88.74 |
| | Conventional Bimetal (Internal Ring + Insert) | 60 |

According to the second embodiment like the first embodiment described before, the assemble coherence between the external ring 5 and the bimetal assembly (configured of the internal ring 1 and the insert 3) and the assembly coherence between the internal ring 1 and the insert 3 may be noticeably improved, compared with the conventional bimetal according to the related art.

The reason why the assembly coherence is improved is that the external ring 5 forcedly and insertedly coupled with the internal ring is employed as external mold with respect to the internal ring 1 and that a predetermined force is transmitted to the internal ring 1 from the external ring 5 accordingly, like the first embodiment.

This force is transmitted to the assembled portion between the insert 3 and the internal ring 1, that is, the assembled portion between the second recess 4 of the insert 3 and the inner surface of the internal ring 1 via the internal ring 1. Because of that, the assembly coherence is improved more than the assembly coherence simply between the insert 3 and the internal ring 1.

In other words, the force generated by the pressure of the external ring 5 is added to the assembly coherence generated in the assembled portion of the conventional bimetal assembly and the assembly coherence is improved accordingly.

In the meanwhile, the insert 3 is forcedly inserted in or insertedly coupled to the internal ring 1, in the state of the external ring 5 being assembled with the internal ring 1, that is, in the state of the inner surface of the external ring 5 being inserted in or insertedly coupled to the first recess 2 formed in the outer surface of the internal ring 1. Because of that, a predetermined pushing force toward the internal ring 1 from the insert 3 is applied and this force is transmitted to the assembled portion between the external ring 5 and the internal ring 1 via the internal ring 1.

As a result, the assembly coherence in the state of the insert 3 being inserted in the internal ring 1 may be noticeably improved, compared with the simple assembly coherence between the external ring 5 and the internal ring 1.

That is, the predetermined force generated by the compression of the insert is added to the assembly coherence between the external ring 5 and the internal ring 1 and the overall assembly coherence may be improved more.

As a result, such the improvement of the assembly coherence according to the second embodiment allows the assembly state of the triple metal coin assembly or medal assembly to be kept more stably and advantageously.

In the meanwhile, also according to the second embodiment, the inner surface of the internal ring 1 is inserted in or insertedly coupled to the second recess 4 of the insert 3 and the inner surface of the external ring is inserted in the first recess 2 of the internal ring 1. However, there may be little transformation of the exterior surface and little difference between the thickness of the internal ring 1 and the insert 3 and the thickness of the external ring 5. Because of that, an exterior beauty of the surface of the triple metal coin assembly or medal assembly may be maintained excellent.

In addition, the internal ring and the insert according to the present invention may be punched perpendicularly and the outer surface is processed to have a circular-shaped projected circumference (single row and two rows type), the recess (single-recess and double-recess) and engraving-shape and it is punched and annealed. Because of that, the outer surfaces of the internal ring and insert may be processed, regardless of the punching process.

The predetermined portion of the inner surfaces of the external and internal rings forms metal flow toward the first and second recesses formed in the outer surfaces of the insert and the internal ring by an external shock such as the press.

For the assembling of the triple metal medal assembly or coin assembly, the outer surfaces of the internal ring and insert have to be embossed-carving or depressed-carving. If the outer surfaces of the internal ring and insert are assembled without process of the embossed-carving, the external ring, the internal ring and the insert of the triple metal coin happen to be separated from each other by a shock in the post-assembly process and distribution process.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

The invention claimed is:

1. A method for fabricating a coin assembly comprising:

(a) step configured to perpendicularly punch inner and outer surfaces of an external ring and to anneal and acid-pickle the punched inner and outer surfaces;

(b) step configured to perpendicularly punch inner and outer surfaces of an internal ring and to process a recess in the outer surface, and configured to process an edge in a circumference of at least one of front and rear surfaces of the insert and to anneal and to anneal and acid-pickle the edge;

(c) step configured to punch and anneal an insert and to process a recess in an outer surface of the insert, and configured to process an edge in at least one circumference of front and rear surfaces of the insert and to acid-pickle the edge; and (d) step configured to couple the insert to the inner surface of the internal ring and to press-assemble the insert, the internal ring and the external ring with each other simultaneously to allow the inner surface of the internal ring inserted in the recess of the insert and the inner surface of the external ring inserted in the recess of the internal ring.

2. A method for fabricating a medal assembly comprising:

(e) step configured to perpendicularly punch inner and outer surfaces of an external ring and to anneal and acid-pickle the inner and outer surfaces;

(f) step configured to perpendicularly punch inner and outer surfaces of an internal ring and to process a recess in the outer surface, and configured to process an edge in at least one circumference of front and rear surfaces of the internal ring and to anneal and acid-pickle the edge;

(g) step configured to punch and anneal an insert and to process a recess in an outer surface of the insert, and configured to process an edge in at least one circumference of front and rear surfaces of the insert and to acid-pickle the edge; and (h) step configured to couple the insert to the inner surface of the internal ring and the external ring to the outer surface of the internal ring, and configured to press-assemble the insert and the external ring with each other simultaneously to allow the inner surface of the internal ring inserted in the recess of the insert and the inner surface of the external ring inserted in the recess of the internal ring.

* * * * *